US008245882B1

(12) United States Patent
Federighi

(10) Patent No.: US 8,245,882 B1
(45) Date of Patent: Aug. 21, 2012

(54) POURING SPOUT FOR AERATING POURED LIQUID

(76) Inventor: William D. Federighi, Novato, CA (US)

( * ) Notice: Subject to any disclaimer, the term of this patent is extended or adjusted under 35 U.S.C. 154(b) by 431 days.

(21) Appl. No.: 12/653,848

(22) Filed: Dec. 18, 2009

(51) Int. Cl.

| | |
|---|---|
| ***B67D 7/76*** | (2010.01) |
| ***B67D 3/00*** | (2006.01) |
| ***B65D 5/72*** | (2006.01) |
| ***B65D 25/40*** | (2006.01) |
| ***B65D 35/38*** | (2006.01) |
| ***B01F 3/04*** | (2006.01) |

(52) U.S. Cl. ..... 222/190; 222/481.5; 222/567; 261/76; 261/DIG. 75

(58) Field of Classification Search ..... 222/190, 222/478, 479, 481.5, 567, 569; 261/76, DIG. 75; 99/323.1; 426/474
See application file for complete search history.

(56) References Cited

U.S. PATENT DOCUMENTS

| | | | | |
|---|---|---|---|---|
| 3,235,133 | A * | 2/1966 | Zimmerman et al. | 222/478 |
| 413,564 | A | 1/1979 | Shaw | |
| 4,322,292 | A * | 3/1982 | Knox | 239/428.5 |
| 459,512 | A | 6/1986 | Schultz | |
| 4,595,121 | A * | 6/1986 | Schultz | 222/1 |
| 4,815,241 | A * | 3/1989 | Woodson | 451/102 |
| 4,861,352 | A * | 8/1989 | Cheng | 75/708 |
| 486,911 | A | 9/1989 | Meyrat | |
| 5,467,896 | A * | 11/1995 | Hols | 222/83 |
| 6,371,332 | B1 * | 4/2002 | Fox | 222/190 |
| 6,568,660 | B1 * | 5/2003 | Flanbaum | 261/76 |
| 741,617 | A1 | 8/2008 | Brice | |
| 7,527,180 | B2 * | 5/2009 | Allen et al. | 222/481.5 |
| 7,841,584 | B2 * | 11/2010 | Sabadicci et al. | 261/76 |
| 8,011,540 | B1 * | 9/2011 | Peckels | 222/479 |
| 8,069,778 | B2 * | 12/2011 | Gierth et al. | 99/452 |
| 2007/0256568 | A1 | 11/2007 | Nudi | |
| 2010/0011967 | A1 * | 1/2010 | Barberio et al. | 99/323.1 |

* cited by examiner

*Primary Examiner* — Kevin P Shaver
*Assistant Examiner* — Matthew Lembo
(74) *Attorney, Agent, or Firm* — Howard Cohen

(57) ABSTRACT

A wine pouring spout that aerates the wine pouring therethrough comprises a generally tubular construction with a flow path extending along the axis of the spout. The flow path is provided with a Venturi constriction, and a Venturi intake port delivers ambient air to the low pressure zone of the constriction. A separate displacement air intake channel feeds displacement air into the interior of the wine bottle to replace wine discharged from the spout. The Venturi intake port includes a Venturi jet bushing with a jet passage therethrough. The Venturi intake port and the displacement air intake are located within a hooded rectangular housing extending outwardly and provided with a distal air opening. The housing directs ambient air to the Venturi intake port and the displacement air intake; and it catches any wine drops that may escape from the Venturi intake port.

5 Claims, 2 Drawing Sheets

POURING SPOUT FOR AERATING POURED LIQUID

CROSS-REFERENCE TO RELATED APPLICATIONS

Not applicable.

FEDERALLY SPONSORED RESEARCH

Not applicable.

SEQUENCE LISTING, ETC ON CD

Not applicable.

BACKGROUND OF THE INVENTION

1. Field of the Invention

The present invention relates to a pourer for simultaneously pouring liquid from a container and mixing air into the liquid. In particular, the pourer may be used for simultaneously pouring wine from a bottle and decanting the wine.

2. Description of Related Art

Typically, wine is decanted by pouring wine from a bottle into a decanter, Typically, the decanter is placed on a table, and the wine is poured from a distance of approximately 10-20 cm above the top of the decanter, so as to aerate and oxidize the wine on its trajectory from the outlet of the bottle neck to the inlet of the decanter. Or, wine is poured directly into wine glasses, from which it is quaffed by the consumer.

It is considered desirable for wine, red wine in particular, to "breathe" one hour or so before being consumed. It is known that some tannin compounds become oxidized by exposure to air and lose their bitter or stringent tastes, creating a more mellow wine and enabling the perception of flavors that otherwise would be masked. The use of a decanter facilitates that process, but it still requires some latent time before the wine should be consumed.

In order to facilitate pouring of wine out of the bottle and to prevent droplets of wine from being spilled when stopping or interrupting pouring, various wine pourers have been suggested in the prior art. And there is known in the prior art at least one wine pouring spout that attempts to aerate the wine as it is discharged from the bottle through the spout. For example, U.S. Pat. No. 6,568,660 describes a pouring spout that has one end adapted to fit into the opening of a wine bottle and a flow path extending directly therethrough. The flow path is provided with a Venturi constriction at a medial portion thereof, and an air intake port delivers ambient air to the low pressure zone of the Venturi constriction.

Although this prior art device appears effective in the patent description, the real-world device suffers from a fundamental drawback: it fails to draw sufficient ambient air to actually introduce air bubbles into the fluid stream and achieve aeration. In this sense it is a complete failure. Thus there is a need in the prior art for a wine pouring spout that aerates the wine thoroughly and effectively as it is poured through the spout.

BRIEF SUMMARY OF THE INVENTION

The present invention generally comprises a wine pouring spout that is improved to aerate the wine pouring therethrough in an efficient and thorough manner.

In one aspect the pouring spout comprises a generally tubular construction with a flow path extending along the axis of the spout. The flow path is provided with a Venturi constriction, and a Venturi intake port delivers ambient air to the low pressure zone of the constriction, as is generally known in the prior art. A salient aspect of the invention is the provision of a separate displacement air intake channel to feed displacement air into the interior of the wine bottle, so that wine discharged from the spout is replaced by an equal volume of displacement air. In this manner the pouring spout maintains ambient air pressure inside the wine bottle, which enables the Venturi constriction to function properly and draw in ambient air to the wine stream through the Venturi intake port.

The displacement air intake channel may be comprised of a narrow tube extending from the proximal end of the wine pouring spout into the neck of the bottle when the spout is secured in the bottle opening. The narrow tube in cross-section has a convex surface that subtends a small portion of the bottle neck's interior surface, and a secant surface that spans the convex surface. The narrow tube has a hollow central flow space that is open at the proximal end and is connected at the distal end to a displacement air intake at the exterior surface of the wine pouring spout.

In a further aspect the Venturi intake port is comprised of a bore extending generally perpendicularly to the liquid flow path at the Venturi constriction. A salient feature of this arrangement is that a Venturi jet bushing is secured within the Venturi intake bore and provided with a jet passage that admits ambient air into the low pressure zone through the restricted flow space of the jet. Moreover, the jet bushing includes an interior end surface that is recessed from the adjacent surface of the Venturi constriction, which aids in drawing air into the fluid flow through the Venturi constriction.

Another important aspect of the invention is the location of the Venturi intake port in a position adjacent to the displacement air intake at an exterior surface portion of the pouring spout. A hooded rectangular housing is disposed at the exterior surface portion and is provided with a distal opening for the free flow of ambient air therethrough. The housing has an outer wall, sidewalls, and an end wall that enclose the space about the exterior surface portion. As a result, the housing serves two distinct purposes: it directs ambient air to the Venturi intake port as well as the displacement air intake; and it catches any wine drops that may escape from the Venturi intake port. Since the wine bottle is usually upright, these drops will flow gravitally in the housing and enter the displacement air intake, and directed by the displacement air channel back into the interior of the bottle. Thus the displacement air channel also serves two distinct purposes: supplying air to replace wine discharged from the spout, and catching any errant wine drops from the spout.

DETAILED DESCRIPTION OF THE INVENTION

Figure 1:
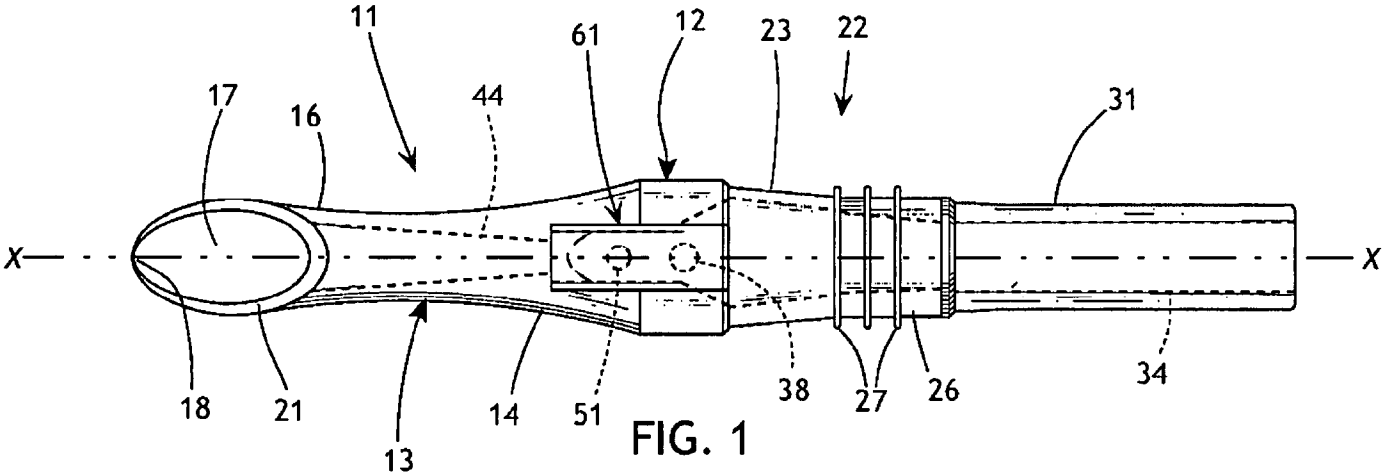
FIG. 1 is a plan view of the wine pouring and aerating spout of the present invention.
Figure 2:
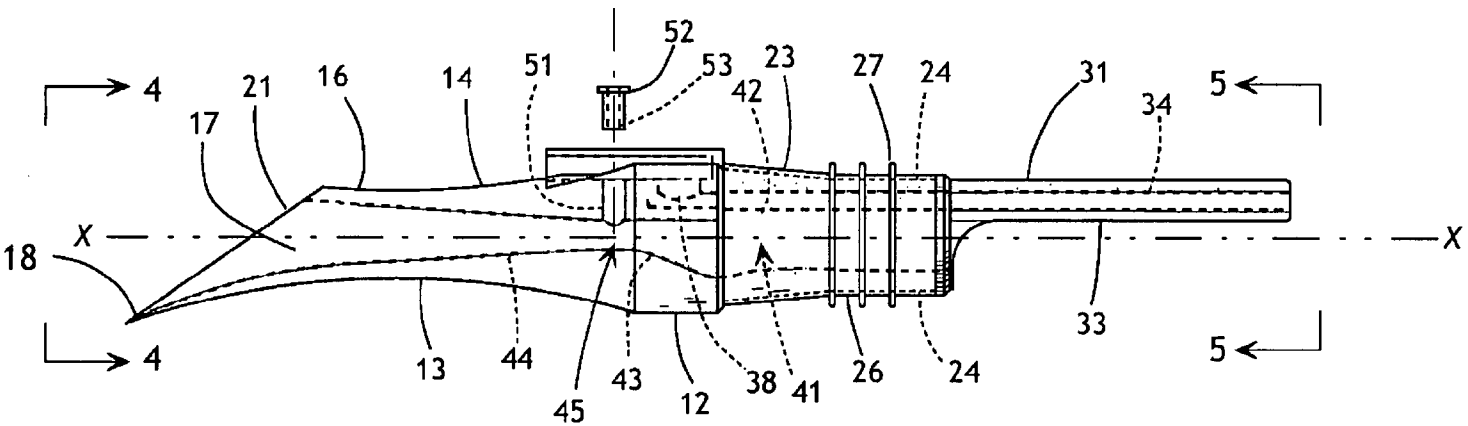
FIG. 2 is a partially exploded side elevation of the wine pouring and aerating spout of FIG. 1.

The present invention generally comprises a wine pouring spout that is improved to aerate the wine pouring therethrough in an efficient and thorough manner. With regard to FIGS. 1-3, the wine pouring spout 11 is comprised of a generally tubular construction having a cylindrical midsection 12 and a distal end portion 13 extending axially therefrom along axis X. The distal portion 13 includes a distally tapering section 14 leading to a midpoint, and a flared section 16 extending distally therefrom, all in smoothly radiused transitions. The distal end of section 16 is a planar truncation 21 extending obliquely to intersect the axis X, and a discharge opening 17 is formed in the truncated end, defining therewith a sharp drip edge 18.

The spout 11 also includes a proximal end portion 22 extending axially from the midsection 12 as a tapering conical section 23 leading to a cylindrical portion 24, all aligned axially. A sleeve-like bushing 26 is formed of a resilient elastomeric material and is dimensioned to be received about the cylindrical portion 24. The outer surface of bushing 26 is provided with one or more annular ribs 27. The outer diameter of the ribs is slightly greater than the inner diameter of a standard wine bottle opening, and the resilient material is capable of compressing elastically and forming a resilient, force-fit, leak-proof seal when inserted in the opening of a wine bottle. The tapered section 23 also aids in providing a resilient sealing engagement in the mouth of a typical wine bottle or the like. Thus the pouring spout assembly 11 is self-retaining in the mouth of a typical wine bottle, and easily placed therein and removed therefrom by manual effort.

Figure 3:
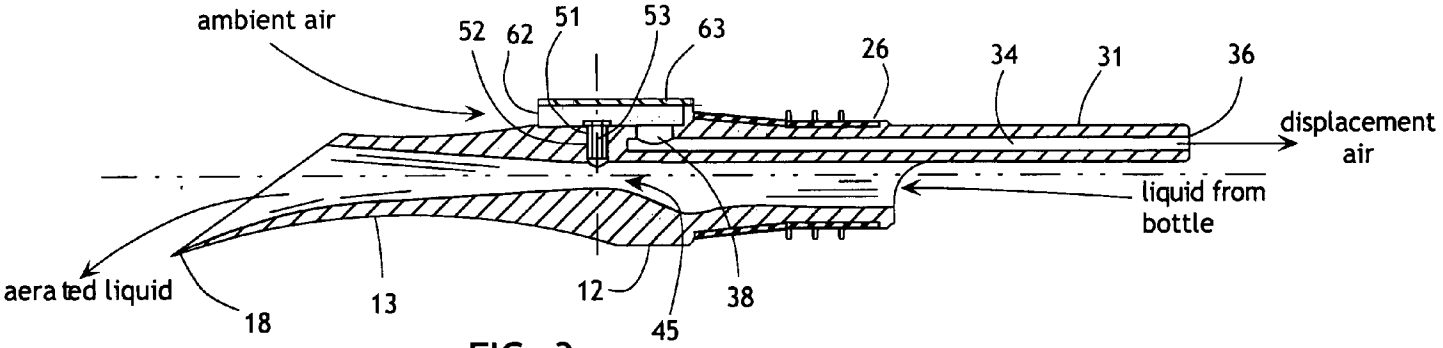
FIG. 3 is a cross-sectional side elevation of the wine pouring and aerating spout of FIGS. 1 and 2.
Figure 5:
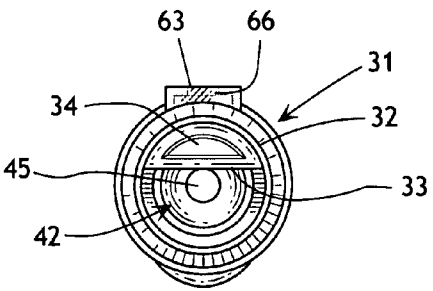
FIG. 5 is a proximal end view of the wine pouring and aerating spout of the invention, taken along line 5-5 of FIG. 1.
Figure 4:
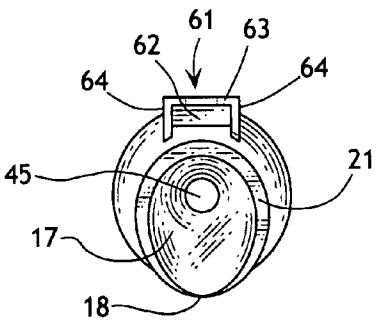
FIG. 4 is a distal end view of the wine pouring and aerating spout of the invention, taken along line 4-4 of FIG. 1.

The spout assembly 11 further includes a displacement air tube 31 extending proximally from the end of section 26 and disposed parallel to and radially offset from the axis X. With regard to FIG. 5, the narrow tube 31 in cross-section has a convex surface 32 that subtends a small portion of the bottle neck's interior surface and is complementary to the curvature of that interior surface. A secant surface 33 spans the convex surface 32 and defines a hollow central flow space 34 that extends longitudinally and is open at the proximal end 36 (FIG. 3). At the distal end the flow space 34 is connected to a displacement air intake 38 extending out of the midsection 12 of the spout assembly 11. Thus when the spout 11 is placed in the opening of a wine bottle there is an unobstructed airflow path from the exterior of the spout assembly 11 to the interior of the wine bottle.

A significant feature of the spout assembly 11 is a bore 41 extending generally axially therethrough. The bore 41 includes a proximal portion 42 extending through sections 23 and 24 of the spout assembly, the portion 42 being substantially cylindrical except for the presence of the secant surface 33 which reduces the flow space of the bore to a small extent. The portion 43 of the bore extends through the midsection 12 and tapers sharply in the distal direction to form a Venturi constriction 45 having a flow space approximately 1/10 of the bore portion 42. In accordance with the observations of Venturi and the equations developed by Bernoulli, the pressure of the liquid flowing through the Venturi constriction 45 is substantially reduced in a direction perpendicular to the liquid flow. In the portion 13 of the spout assembly 11, the bore portion 44 flares distally from the narrow constriction of the Venturi throat 45 to the distal discharge opening 17. Note that the surface of bore portion 44 intersects both the truncation plane 21 and the exterior surface of portion 13 at the distal tip 18 to form a sharp pouring edge that tends not to retain a drop of liquid when the pouring stops.

The spout assembly 11 also provides a Venturi intake port 51 extending from a point slightly downstream (distal) of the Venturi throat 45, to the exterior of the spout assembly. Thus an airstream is introduced to the low pressure zone at the Venturi constriction 45 to aerate the liquid flowing therethrough. In addition, the invention provides a Venturi jet bushing 52 (see FIGS. 2 and 3) that is press fit into the port 51 and is provided with a narrow diameter jet opening 53 that delivers and directs a high velocity air jet at the liquid flowing past the port 51. Note that as shown in FIG. 3, the jet bushing 52 is slightly shorter than the length of port 51, so that there is a small distance between the inner end of the bushing 52 and the sidewall of the Venturi throat 45. This space appears to be an important factor in creating air bubbles in the liquid stream flowing through the bore.

Another important aspect of the invention is the location of the Venturi intake port 51 in a position longitudinally adjacent to the displacement air intake 38 at an exterior surface portion of the pouring spout. A hooded rectangular housing 61 is disposed at the exterior surface portion and is provided with a distal opening 62 for the free flow of ambient air therethrough. The housing has an outer wall 63, parallel sidewalls 64, and a proximal end wall 66 that enclose the space about the exterior surface portion. The housing 61 is designed synergistically to serve two distinct purposes: it directs ambient air to the Venturi intake port 51 as well as the displacement air intake 38; and it catches any wine drops that, in an unlikely event, may escape from the Venturi intake port. Note that when the pour spout 11 is installed in a wine bottle opening, the distal end of the spout extends upwardly and the distal opening 62 also opens upwardly, and any liquid drops retained in the pour spout tend to flow gravitally back into the bottle through passageway 42 or displacement air channel 34.

Figure 6:
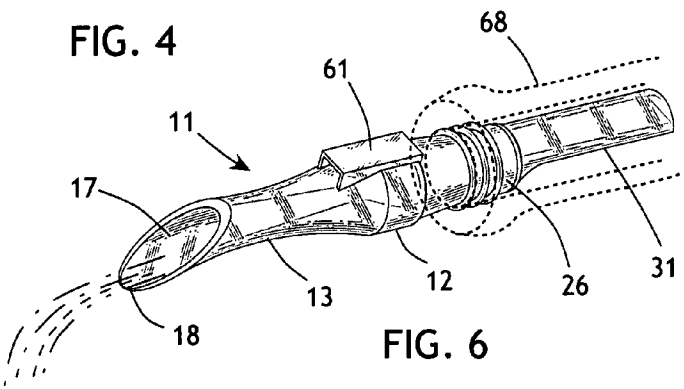
FIG. 6 is a perspective view of the wine pouring and aerating spout of the invention shown in typical use.

The procedure for using the wine pouring spout assembly 11 as described above is simple and effective. Directly after a bottle of wine is opened (e.g., uncorked), the proximal end of the spout assembly 11 is placed into the opening of the bottle, and inserted until the resilient bushing 26 lodges firmly in the mouth of the bottle. The bottle 68 is then tipped, as shown in FIG. 6, causing the liquid in the bottle to flow through the bore passageway 42, the Venturi constriction 45, and through the bore portion 44 to be discharged from the pouring lip 18 of the distal opening 17. With reference to FIG. 3, the volume of wine discharged from the bottle is replaced directly by ambient air flowing through opening 62 into displacement air intake 38, and thence through flow channel 34 into the airspace in the bottle. At the same time, the velocity of the liquid flowing through the Venturi throat 45 creates a low pressure zone therein that induces an air flow through opening 62 and into Venturi intake port 51. The Venturi jet 53 creates a narrow high velocity air stream that produces bubbles in the liquid stream flowing through the Venturi throat, resulting in aerated liquid discharged from the pouring spout through opening 17. The spout directly outflow therefrom very precisely, enabling a host to pour into glasses of any size and shape. Most importantly, there is no need to wait for a good red wine to breathe for an hour or more, when the simple act of pouring that wine produces the aeration that enables the wine to be consumed without delay.

It may be appreciated that the spout assembly may be easily removed from a wine bottle or similar container, washed and rinsed, and re-used indefinitely. It is not intended as a cork replacement for long-term storage of wine after the bottle has been opened.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A pouring spout for pouring liquid from a container while simultaneously aerating the liquid discharged from the spout and including a tubular body having a liquid flow path extending longitudinally therethrough and a Venturi constriction located in the flow path and a Venturi air intake opening into the Venturi constriction to aerate the liquid as it flows therethrough, the improvement comprising:

a displacement air channel extending from an exterior portion of said pouring spout to an interior portion of the container to enable a flow of air to replace a mass of liquid discharged from said spout;

said displacement air channel including a displacement air intake opening to the exterior portion of said spout, said displacement air channel extending from said displacement air intake to the interior of the container;

said Venturi air intake extending to the exterior portion of said spout adjacent to said displacement air intake;

a housing extending outwardly from the exterior portion and including an ambient air intake to supply air to both said Venturi air intake and said displacement air intake;

said housing also comprising means to direct any drops of liquid from said Venturi air intake retrograde into said displacement air intake and thence through said displacement air channel to the interior of the container.

2. The pouring and aerating spout of claim 1, wherein said means to direct any drops includes positioning said displacement air intake at the lowest point within said housing when said spout is upwardly directed and installed in a container opening.

3. The pouring and aerating spout of claim 2, wherein said displacement air channel further includes a tube extending proximally from said spout into the container, said displacement air channel extending longitudinally through said tube.

4. A pouring spout for pouring liquid from a container while simultaneously aerating the liquid discharged from the spout and including a tubular body having a liquid flow path extending longitudinally therethrough and a Venturi constriction located in the flow path and a Venturi air intake opening into the Venturi constriction to aerate the liquid as it flows therethrough, the improvement comprising:

a displacement air channel extending from an exterior portion of said pouring spout to an interior portion of the container to enable a flow of air to replace a mass of liquid discharged from said spout;

said Venturi air intake extending to an exterior surface portion of said spout;

further including a jet bushing received in said Venturi air intake and having a jet opening disposed to direct a high velocity air jet into the liquid flow path in said Venturi constriction;

wherein said jet bushing is shorter in length than the length of said Venturi air intake to form an air gap at the inner end of said Venturi air intake.

5. A pouring spout for pouring liquid from a container while simultaneously aerating the liquid discharged from the spout and including a tubular body having a liquid flow path extending longitudinally therethrough and a Venturi constriction located in the flow path and a Venturi air intake opening into the Venturi constriction to aerate the liquid as it flows therethrough, the improvement comprising:

said Venturi air intake extending to an exterior portion of said spout, a jet bushing received in said Venturi air intake and having a jet opening disposed to direct a high velocity air jet into the liquid flow path in said Venturi constriction;

a displacement air channel extending from the exterior portion of said pouring spout to an interior of the container to enable a flow of air to replace a mass of liquid discharged from said spout;

said displacement air channel including a displacement air intake opening to said exterior portion of said spout, and a displacement air channel extending from said displacement air intake to the interior of the container;

a housing extending outwardly from said exterior of said pouring spout and including an ambient air intake to supply air to both said Venturi air intake and said displacement air intake;

said housing also comprising means to direct any drops of liquid from said Venturi air intake retrograde into said displacement air intake and thence through said displacement air channel to the interior of the container.

* * * * *